US010590609B2

(12) United States Patent
Pesqueux et al.

(10) Patent No.: US 10,590,609 B2
(45) Date of Patent: Mar. 17, 2020

(54) SHELL CROSS-MEMBER SYSTEM AND RAILWAY SECTION INCLUDING SUCH A SYSTEM

(71) Applicant: ALSTOM TRANSPORT TECHNOLOGIES, Saint-Ouen (FR)

(72) Inventors: Lise Pesqueux, Paris (FR); Arnaud Loaec, Cachan (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 290 days.

(21) Appl. No.: 15/460,932

(22) Filed: Mar. 16, 2017

(65) Prior Publication Data

US 2017/0268179 A1 Sep. 21, 2017

(30) Foreign Application Priority Data

Mar. 18, 2016 (FR) ..... 16 52356

(51) Int. Cl.

| | |
|---|---|
| ***E01B 3/32*** | (2006.01) |
| ***E01B 3/36*** | (2006.01) |
| ***E01B 9/10*** | (2006.01) |
| ***E01B 9/68*** | (2006.01) |

(52) U.S. Cl.

CPC ..... *E01B 3/32* (2013.01); *E01B 3/36* (2013.01); *E01B 9/10* (2013.01); *E01B 9/68* (2013.01)

(58) Field of Classification Search

CPC ... E01B 1/005; E01B 3/32; E01B 3/36; E01B 3/44; E01B 9/68; E01B 2204/01

USPC ..... 238/29

See application file for complete search history.

(56) References Cited

U.S. PATENT DOCUMENTS

| | | | | |
|---|---|---|---|---|
| 5,551,631 | A * | 9/1996 | Cailliau | E01B 1/00 238/115 |
| 5,713,518 | A | 2/1998 | Fox et al. | |
| 6,179,215 | B1 | 1/2001 | Shea | |
| 2004/0191084 | A1* | 9/2004 | Wang | F04B 39/0033 417/312 |
| 2008/0083835 | A1 | 4/2008 | Girardi et al. | |
| 2015/0064379 | A1* | 3/2015 | Roberts | B29C 49/04 428/36.5 |
| 2015/0308051 | A1* | 10/2015 | De Lisi | E01B 3/44 238/85 |

(Continued)

FOREIGN PATENT DOCUMENTS

| | | |
|---|---|---|
| CN | 104937170 A | 9/2015 |
| EP | 0 919 666 A1 | 6/1999 |
| FR | 2 906 69 A1 | 3/2008 |

(Continued)

OTHER PUBLICATIONS

FR Search Report, dated Nov. 23, 2016, from corresponding FR application.

*Primary Examiner* — Zachary L Kuhfuss
(74) *Attorney, Agent, or Firm* — Young & Thompson

(57) ABSTRACT

This cross-member system with shell (10) for a railroad track, intended to be wedged in an apron of the railroad track, of the type including a cross-member (12) having a lower face (20), and an upper face (22) that is intended to receive a rail fastening system (14), and a shell, is characterized in that the shell envelops substantially the entire cross-member so as to define an inner volume for receiving the cross-member that is sealed against outside attacks.

14 Claims, 3 Drawing Sheets

(56) References Cited

U.S. PATENT DOCUMENTS

| | | | | |
|---|---|---|---|---|
| 2015/0330031 | A1* | 11/2015 | Van Erp | B32B 7/02<br>238/115 |
| 2017/0268179 | A1* | 9/2017 | Pesqueux | E01B 3/32 |

FOREIGN PATENT DOCUMENTS

| | | | |
|---|---|---|---|
| WO | 2012/058447 | A2 | 5/2012 |
| WO | 2014/108868 | A1 | 7/2014 |

* cited by examiner

SHELL CROSS-MEMBER SYSTEM AND RAILWAY SECTION INCLUDING SUCH A SYSTEM

FIELD OF THE INVENTION

The present invention relates to a cross-member system with shell of the type comprising a cross-member having a lower face, and an upper face that is intended to receive a rail fastening system, and a shell.

BACKGROUND OF THE INVENTION

In the present document, a cross-member refers to any type of wood, metal, concrete piece, placed perpendicular to the railway track, and intended to support the rails, maintain their separation, and distribute loads. This may thus be a single-piece cross-member supporting two rails with two lines of rails, or a dual-block cross-member including two concrete rail supporting blocks, each concrete rail supporting block supporting a rail of one of the lines of rails, the two concrete rail supporting blocks being secured, or not secured, by a spacer.

DESCRIPTION OF THE RELATED APPLICATION

Document FR 2,906,269 A1 discloses a system of the aforementioned type, in which, as shown in FIG. 1, the shell forms a liner 6 defining a housing for receiving the lower portion of the cross-member 12, made from concrete. The bottom of the liner 6 is made of an elastic soleplate 17 on which the cross-member 12 rests, in whole or in part.

The system is supplied assembled on the railway track production worksite. It is kept in position suspended from the rails for the time needed to pour the concrete of a support apron of the track. Once the concrete has set, the system is wedged in position. If the liner is secured to the apron, the cross-member can move sideways and elastically relative to the liner, owing to the soleplate 17. This makes it possible to absorb vibrations upon passage of the vehicles.

A sealing gasket 8, or more generally an element forming a sealing gasket, is provided between the upper rim of the peripheral wall of the liner 6 and the side walls of the cross-member 12. The purpose of this seal is to prevent water or fine particles from infiltrating inside the liner, between the liner and the cross-member, risking blocking the possibility of movement of the cross-member.

The placement of this seal is a step in the manufacturing method of such a system that requires labor. This results in a high cost of the obtained system and a placement quality of the seal that depends on the operator.

Furthermore, during the transport and handling of the system, deformations of the system may result in loosening the seal from the cross-member. Once the system is fixed in the apron, it is then necessary to use a large quantity of adhesive to fasten the seal to the cross-member again so as to reestablish the sealing. Here again, this is an operation whose performance quality depends on the dexterity of the operator.

SUMMARY OF THE INVENTION

The invention therefore aims to resolve these problems.

To that end, the invention relates to a system of the aforementioned type, characterized in that the shell envelops substantially the entire cross-member so as to define an inner volume for receiving the cross-member that is sealed against outside attacks.

According to other optional features of the invention:

- the shell includes: a lower half-shell, called liner, able to receive the cross-member, the liner including a bottom and a raised peripheral wall bordering the bottom; and an upper half-shell, called cover, able to receive the cross-member, the cover including a ceiling and a fallen peripheral wall, rims of the peripheral wall of the liner and the peripheral wall of the cover cooperating to sealably close the shell;
- the rim of the peripheral wall of the cover is provided with a collar laterally covering the rim of the peripheral wall of the liner;
- a sealing gasket is kept compressed between the rim of the peripheral wall of the cover and the rim of the peripheral wall of the liner;
- the cover is fixed to the liner by snapping or riveting of their rims;
- the system includes a rail fastening system mounted on the upper face of the cross-member;
- the shell is sandwiched between the rail fastening system and the cross-member;
- the shell includes an aperture whose contour is configured to engage a slot provided on the upper face of the cross-member around an installation zone of the rail fastening system;
- the system includes a resilient soleplate positioned between the cross-member and the shell;
- the shell is made from a rigid material; and The invention also relates to a railway track segment, characterized in that it comprises an apron, a plurality of cross-member systems with shells according to the system described above and a pair of rolling rails that bears on each of these systems.

BRIEF DESCRIPTION OF THE DRAWINGS

The invention will be better understood upon reading the following description, provided as an example, and in reference to the drawings, in which.

DETAILED DESCRIPTION OF THE INVENTION

Figure 1:
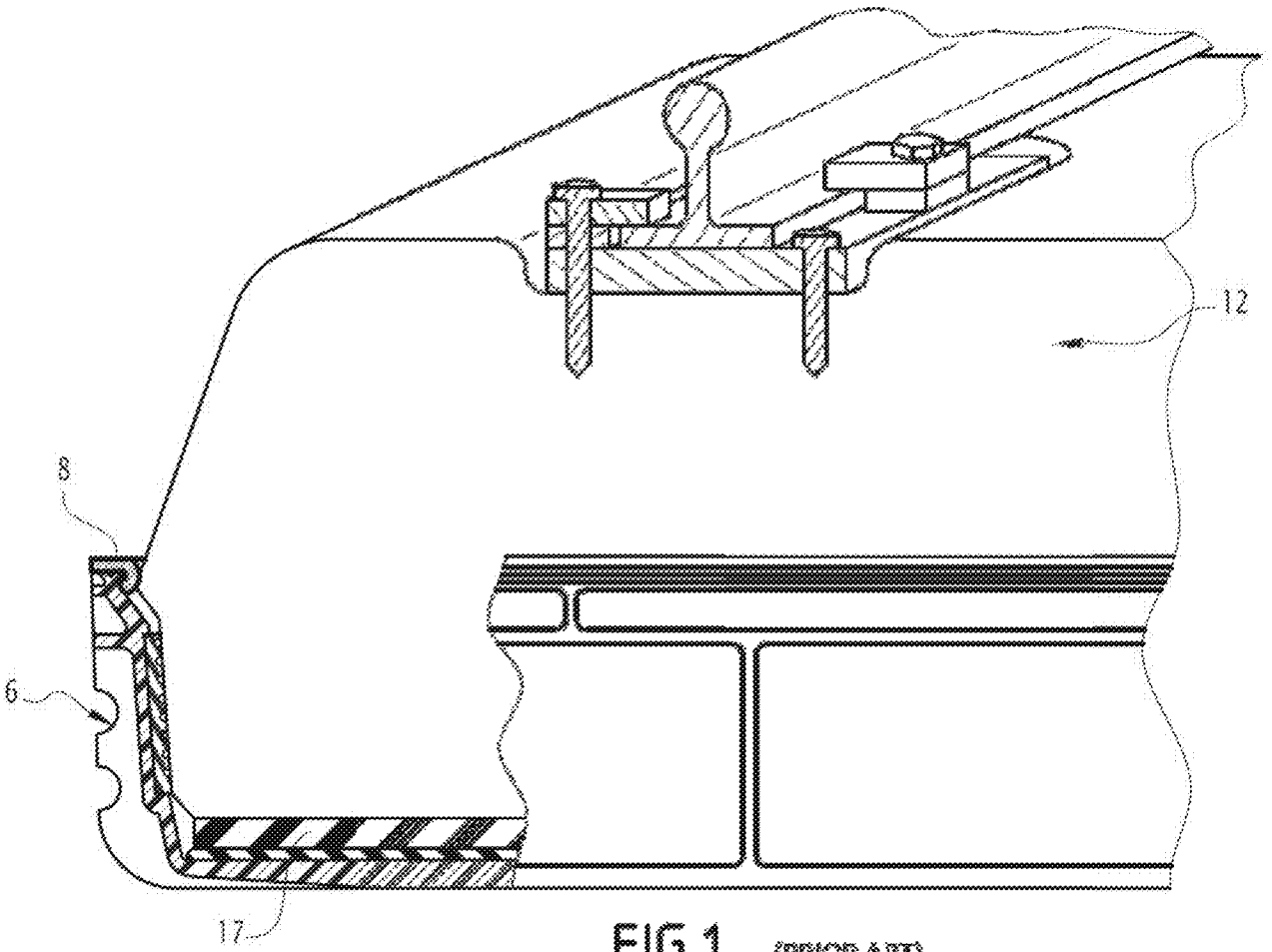
FIG.1 (PRIOR ART)
FIG. 1 is a schematic sectional view transverse to the track of a cross-member system with shell according to the state of the art.
Figure 2:
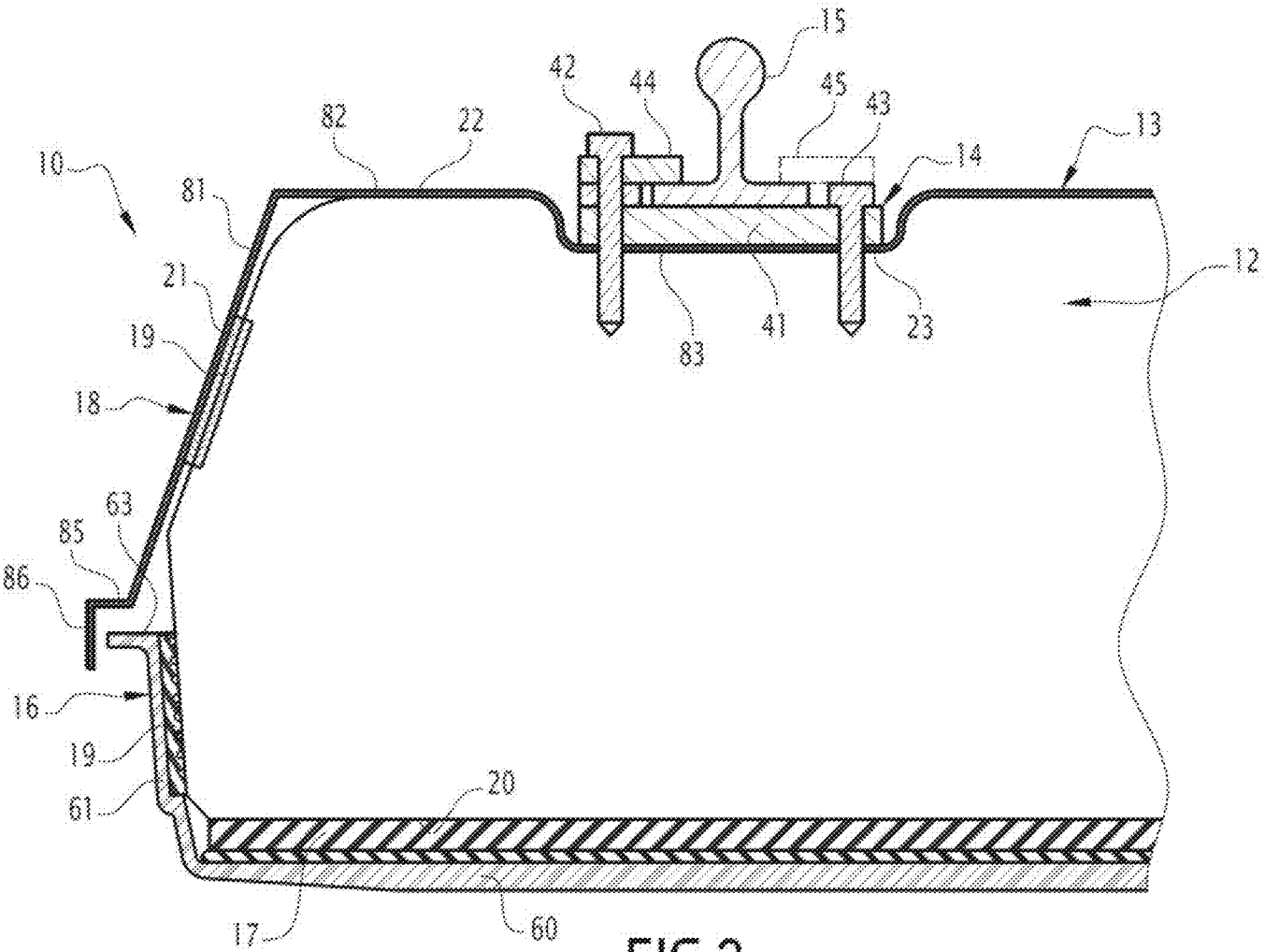
FIG. 2 is a schematic sectional view transverse to the track of a first embodiment of a cross-member system with shell according to the invention.

In reference to FIG. 2, which shows a first embodiment of the cross-member system with shell according to the invention, a system 10 includes a cross-member 12, a shell 13 and a rail fastening system 14.

The rigid cross-member 12 (or crosspiece) is for example made from concrete. In the described example, it has a substantially parallelepiped shape. The cross-member 12 thus includes a lower face 20, an upper face 22 and four side faces 21 connecting the lower and upper faces to one another.

The upper face 22 of the rigid cross-member 12 includes an installation zone 23 for the rail fastening system 14. In the embodiment of FIG. 2, this zone 23 is formed by the bottom of an indentation, substantially square, making it possible to receive a metal plate forming the base 41 of the rail fastening system 14.

The rail fastening system 14 makes it possible to keep a rail 15 in position on the cross-member 12. The rail fastening system 14 includes lag screws 42, 43 screwed into the cross-member 12 to fasten the base 41 on the latter.

The base 41 is a rectangular plate having a width smaller than that of the cross-member 12 and a thickness substantially equal to the height of the indentation defining the installation zone 23 of the system 14 on the cross-member 12. Such a plate is generally made from metal, but rigid plates made from a composite material are now commercially available. It is inserted between the rail 15 and the cross-member 12. The rail fastening system is therefore called an indirect fastening system.

The rail fastening system 14 also includes a pair of fasteners 44, 45 making it possible, by screwing the lag screws 42, 43, to jam the shoe of the rail 15 between the fastener and the base. The two fasteners 44 and 45 are placed on either side of a transverse plane of the railway track and median plane of the cross-member 12.

Alternatively, other rail fastening systems, known by those skilled in the art, may also be implemented. For example, the fastener holding the rail can be fixed differently than by the lag screw maintaining the base.

The shell 13 envelops substantially the entire cross-member 12 so as to define an inner volume for receiving the cross-member 12 that is sealed against outside attacks.

In the considered embodiment, the shell is made up of the vertical assembly of two half-shells. Below, the lower half-shell is called liner and the upper half-shell is called cover.

The liner 16 is configured to receive the lower portion of the cross-member 12.

The liner 16 includes a substantially flat bottom 60, and a peripheral wall 61 rises from the bottom 60 and ends with a free rim 63.

The cover 18 is configured to cover the upper portion of the cross-member 12. The cover 18 includes a substantially flat ceiling 82, and a peripheral wall 81 that falls from the ceiling 82 and ends with a rim 85.

The rim 85 is provided with a collar 86 widely covering the rim 63 of the liner. This makes it possible to greatly, or even completely, limit the entry of water or dust into the inner volume defined by the shell 13.

Advantageously, the collar 86 makes it possible to secure the cover 18 of the liner 16 by snapping. In this way, the shell formed by the liner and the cover defines a sealed volume protecting the rigid cross-member 12.

To produce this snapping, the liner and the cover have a certain rigidity. The cover 18 and the liner 16 are for example made by thermoforming a suitable plastic material, for example polyvinyl chloride (PVC), or acrylonitrile butadiene styrene (ABS).

Thus, in this embodiment, the system 10 does not include a sealing gasket between the rim 63 of the liner 16 and the side faces 21 of the cross-member 12.

Advantageously, the cover 18 is secured to the cross-member 12. In the first embodiment of FIG. 2, the ceiling 82 of the cover 18 is kept between the base 41 of the rail fastening system 14 and the cross-member 12. More specifically, the ceiling 82 of the cover 18 includes a recess 83, conjugated with the indentation defining the installation zone 23 of the system 14. In this recess 83, through holes are provided so as to allow the insertion of lag screws 42 and 43 fastening the system 14 on the cross-member 12. Maintenance is relatively easy, since it suffices to separate the rail fastening system 14 from the cross-member 12 and remove the lag screws 42 and 43 to release the cover 18, which, once detached from the liner 16, can be replaced.

Preferably, the cross-member system with shell 10 includes a resilient sole plate 17 inserted between the bottom 60 of the liner 16 and the lower surface 20 of the cross-member 12. Also preferably, a plurality of resilient segments 19 are inserted between the peripheral wall either of the liner 16 or of the cover 18 and the side faces 21 of the cross-member 12.

The sole plate 17 and the segments 19 make it possible to absorb vibrations upon passage of trains.

The shell has a relative rigidity allowing it to follow the deformations of the cross-member 12.

Advantageously, a sealing gasket, not shown, is kept compressed between the rim 85 of the peripheral wall 81 of the cover 18 and the rim 63 of the peripheral wall 61 of the liner 20.

Alternatively, the cover 18 is fixed to the liner 16 by riveting of their rims.

Figure 3:
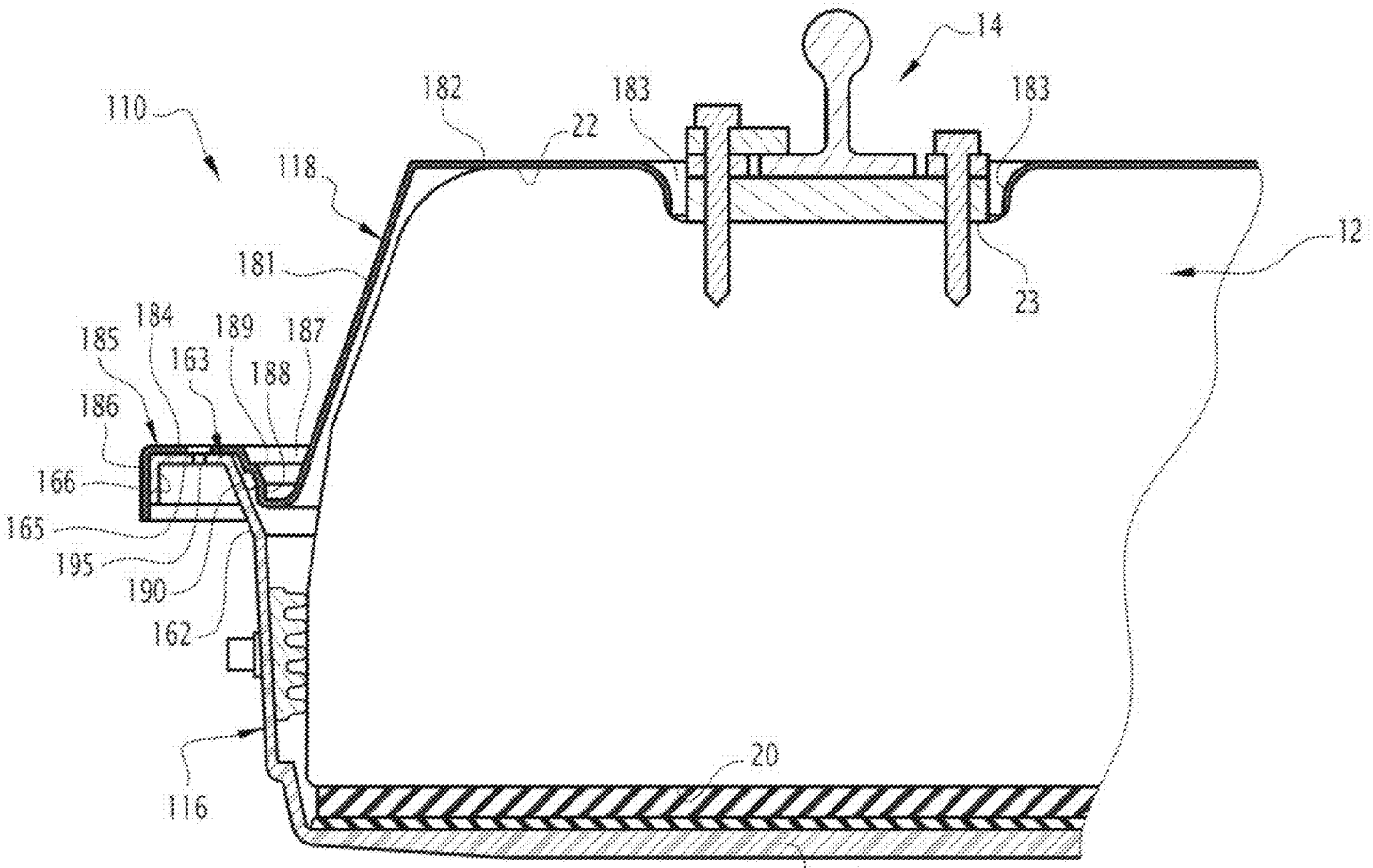
FIG. 3 is a schematic sectional view transverse to the track of a second embodiment of a cross-member system with shell according to the invention.

FIG. 3 shows a second embodiment of a cross-member system with shell according to the invention. In FIG. 3, an element that is identical to an element of FIG. 2 is identified using the reference figure used to identify this corresponding element in FIG. 2, while a similar element is identified by the reference number used to identify this corresponding element increased by one hundred.

In this second embodiment, the manner in which the cover is associated with the liner is modified.

Thus, the rim 163 of the peripheral wall 161 of the liner 116 includes a planar portion 162 inclined outward, a substantially horizontal edge 165 and a falling rim 166.

The rim 185 of the peripheral wall 181 of the cover 118 is intended to cooperate with the rim 163 of the peripheral wall 161.

It therefore includes a portion forming a transom 187, a substantially horizontal edge 184 and a fallen rim 186.

The portion forming a transom 187 has an outer face 188, intended to be pressed against the planar portion 162 of the rim 163 of the liner 116. It consequently has an incline identical to that of this planar portion 162.

The outer face 188 is provided with a slot, which is open toward the planar portion 162. This slot is intended to receive a sealing gasket 190.

In the assembled position of the cover 118 on the liner 116, the sealing gasket 190 is deformed by compression. The transom configuration of the rim 185 makes it possible, by playing on the elasticity of the material making up the cover 118, makes it possible to apply a suitable compression force.

The edge 184 is intended to be pressed against the edge 165. To keep the cover on the liner, rivets 195 are positioned regularly over the entire periphery of the shell. These rivets are inserted into piercings provided on the edges 184 and 165.

In the assembled position, the fallen rim 186 is intended to widely cover the fallen edge 166.

Independently of how the cover and the liner are associated, the method of securing the cover 118 to the cross-member 12 is modified. In this second embodiment, the ceiling 182 of the cover 118 includes an aperture 183. The contour of the aperture 183 is curved inwards so as to cooperate with the edge of the indentation defining the installation zone 23 of the rail fastening system 14.

The cooperation of the contour 183 with the edge of the indentation defining the zone 23 and the association of the liner and the contour makes it possible to guarantee maintenance in position of the cover 118.

More generally, the contour of the aperture 183 is configured to engage in a slot, and for example the edges of a slot, provided on the upper face of the cross-member 12 around the installation zone 23 of the rail fastening system 14. The slot corresponds to the aforementioned indentation.

In the embodiments described here in detail, the liner and the cover are made from a rigid material. Alternatively, the liner and the cover are made from a flexible material, for example rubber.

In the embodiments described here in detail, the liner and the cover are two separate parts made independently of one another, then associated to form the sealed shell. Alternatively, the liner and the cover form a single integral piece making up the shell substantially completely enveloping the cross-member. For example, the shell is then made from a flexible and elastic material making it possible, by deformation, to insert the cross-member inside the shell.

The invention claimed is:

1. A shell cross-member system for a railroad track, configured to be fixed in an apron of the railroad track, the shell cross-member system comprising:

a cross-member having a lower face and an upper face, the upper face receiving a rail fastening system; and a shell that substantially entirely envelops the cross-member to define an inner volume for receiving the cross-member, the inner volume being sealed against outside attacks, the shell comprising a lower half-shell that is a liner, receiving the cross-member, the liner including a bottom and a raised peripheral wall bordering the bottom, and an upper half-shell that is a cover, receiving the cross-member, the cover including a ceiling and a fallen peripheral wall, a rim of the raised peripheral wall of the liner and a rim of the fallen peripheral wall of the cover cooperating to sealably close the shell, the rim of the peripheral wall of the liner including a first planar portion angled outwardly, a first substantially horizontal edge, and a first downward end, the rim of the peripheral wall of the cover including a second portion having an outer face, configured to be pressed against the first planar portion of the rim of the liner and angled identically to the first planar portion, the outer face being provided with a slot that is open toward the first planar portion and that receives a sealing gasket, a second substantially horizontal edge, and a second downward end.

2. The shell cross-member system according to claim 1, wherein the cover is fixed to the liner by snapping or riveting of the rims of the liner and the cover.

3. A railway track segment, comprising:

an apron;

a plurality of the shell cross-member systems according to claim 2, the shell cross-member systems being fixed in the apron; and a pair of rolling rails fastened on each of the shell cross-member systems.

4. The shell cross-member system according to claim 1, further comprising a rail fastening system mounted on the upper face of the cross-member.

5. The shell cross-member system according to claim 4, wherein the shell is sandwiched between the rail fastening system and the cross-member.

6. A railway track segment, comprising:

an apron;

a plurality of the shell cross-member systems according to claim 5, the shell cross-member systems being fixed in the apron; and a pair of rolling rails fastened on each of the shell cross-member systems.

7. The shell cross-member system according to claim 4, wherein the shell includes an aperture, a contour thereof being configured to engage a slot provided on the upper face of the cross-member around an installation zone of the rail fastening system.

8. A railway track segment, comprising:

an apron;

a plurality of the shell cross-member systems according to claim 7, the shell cross-member systems being fixed in the apron; and a pair of rolling rails fastened on each of the shell cross-member systems.

9. A railway track segment, comprising:

an apron;

a plurality of the shell cross-member systems according to claim 4, the shell cross-member systems being fixed in the apron; and a pair of rolling rails fastened on each of the shell cross-member systems.

10. The shell cross-member system according to claim 1, further comprising a resilient soleplate positioned between the cross-member and the shell.

11. A railway track segment, comprising:

an apron;

a plurality of the shell cross-member systems according to claim 10, the shell cross-member systems being fixed in the apron; and a pair of rolling rails fastened on each of the shell cross-member systems.

12. The shell cross-member system according to claim 1, wherein the shell is made from a rigid material.

13. A railway track segment, comprising:

an apron;

a plurality of the shell cross-member systems according to claim 12, the shell cross-member systems being fixed in the apron; and a pair of rolling rails fastened on each of the shell cross-member systems.

14. A railway track segment, comprising:

an apron;

a plurality of the shell cross-member systems according to claim 1, the shell cross-member systems being fixed in the apron; and a pair of rolling rails fastened on each of the shell cross-member systems.

* * * * *